US011840905B2

(12) United States Patent
Wind et al.

(10) Patent No.: US 11,840,905 B2
(45) Date of Patent: Dec. 12, 2023

(54) STAGE TOOL

(71) Applicant: Weatherford Technology Holdings, LLC, Houston, TX (US)

(72) Inventors: Stephanie Dianne Wind, Houston, TX (US); James Frederick Wilkin, Sherwood Park (CA); Douglas Brian Farley, Missouri City, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 1277 days.

(21) Appl. No.: 14/876,308

(22) Filed: Oct. 6, 2015

(65) Prior Publication Data

US 2016/0102526 A1 Apr. 14, 2016

Related U.S. Application Data

(60) Provisional application No. 62/061,522, filed on Oct. 8, 2014.

(51) Int. Cl.

| | |
|---|---|
| ***E21B 34/12*** | (2006.01) |
| ***E21B 34/14*** | (2006.01) |
| ***E21B 33/04*** | (2006.01) |
| ***E21B 33/14*** | (2006.01) |

(52) U.S. Cl.
CPC ..... *E21B 34/12* (2013.01); *E21B 33/146* (2013.01); *E21B 34/142* (2020.05); *E21B 33/14* (2013.01); *E21B 2200/06* (2020.05)

(58) Field of Classification Search
CPC ..... E21B 34/12; E21B 33/146; E21B 34/14; E21B 2034/007; E21B 34/142; E21B 2200/06; E21B 33/14
See application file for complete search history.

(56) References Cited

U.S. PATENT DOCUMENTS 3,385,367 A * 5/1968 Kollsman ..... E21B 33/1208 166/191
4,669,541 A 6/1987 Bissonnette
4,671,356 A * 6/1987 Barker ..... E21B 33/134 166/133
4,706,747 A * 11/1987 Schneider ..... E21B 33/126 166/153
4,718,488 A * 1/1988 Pringle ..... E21B 23/02 166/135

(Continued)

FOREIGN PATENT DOCUMENTS

EP 0224942 A1 * 6/1987 ..... E21B 33/146
EP 0224942 A1 6/1987
EP 2407632 A2 1/2012

OTHER PUBLICATIONS

PCT International Search Report and Written Opinion dated Jan. 18, 2016, for International Application No. PCT/US2015/054217.

(Continued)

*Primary Examiner* — Tara Schimpf
*Assistant Examiner* — Neel Girish Patel
(74) *Attorney, Agent, or Firm* — Peter V. Schroeder; Booth Albanesi Schroeder PLLC

(57) ABSTRACT

A method of closing a stage tool in a wellbore includes releasing a closing tube into the wellbore; attaching the closing tube to the stage tool; and expanding the closing tube, thereby closing a port of the stage tool.

19 Claims, 4 Drawing Sheets

(56) References Cited

U.S. PATENT DOCUMENTS 4,928,772 A * 5/1990 Hopmann ..... E21B 34/12 166/332.1
4,969,513 A * 11/1990 Barrus ..... E21B 21/106 137/493
5,082,062 A * 1/1992 Wood ..... E21B 23/02 166/214
5,165,493 A * 11/1992 Baugh ..... E21B 21/106 137/512.15
5,186,258 A * 2/1993 Wood ..... E21B 23/02 166/115
5,613,557 A * 3/1997 Blount ..... E21B 23/06 166/277
8,800,655 B1 * 8/2014 Bailey ..... E21B 33/146 166/289
9,856,714 B2 * 1/2018 Giroux ..... E21B 33/146
9,982,507 B2 * 5/2018 Murphree ..... E21B 43/11
2002/0014339 A1 * 2/2002 Ross ..... E21B 33/1212 166/380
2002/0174986 A1 * 11/2002 Szarka ..... E21B 33/146 166/289
2005/0173115 A1 * 8/2005 Maimets ..... E21B 29/10 166/277
2007/0246225 A1 * 10/2007 Hailey, Jr. ..... E21B 34/00 166/386
2008/0135260 A1 * 6/2008 Berzin ..... E21B 33/1208 166/380
2009/0056952 A1 * 3/2009 Churchill ..... E21B 34/14 166/373
2010/0163253 A1 * 7/2010 Caldwell ..... E21B 34/12 166/387
2010/0288486 A1 * 11/2010 Kutac ..... E21B 33/1216 166/118
2010/0307748 A1 * 12/2010 Casciaro ..... E21B 34/10 166/277
2012/0012342 A1 * 1/2012 Wilkin ..... E21B 33/1285 166/387
2012/0292030 A1 * 11/2012 Xu ..... E21B 43/26 166/308.1
2012/0325475 A1 * 12/2012 Lee ..... E21B 34/063 166/285
2013/0105158 A1 * 5/2013 Saltel ..... E21B 33/12 166/290
2013/0220606 A1 * 8/2013 Yhuel ..... E21B 43/04 166/278
2013/0220640 A1 * 8/2013 Fripp ..... E21B 43/106 166/386
2013/0220644 A1 * 8/2013 Fripp ..... E21B 43/103 166/387
2014/0060813 A1 * 3/2014 Naedler ..... E21B 43/26 166/135
2014/0196914 A1 * 7/2014 Ring ..... E21B 23/06 166/387
2014/0251691 A1 * 9/2014 Evans ..... E21B 21/103 175/57
2014/0306406 A1 * 10/2014 Hibberd ..... E21B 33/1208 277/336
2015/0021026 A1 * 1/2015 Giroux ..... E21B 33/146 166/289
2015/0159466 A1 * 6/2015 Themig ..... E21B 34/14 166/285
2016/0201440 A1 * 7/2016 Aidagulov ..... E21B 43/26 166/285

OTHER PUBLICATIONS

Canadian Office Action dated Apr. 29, 2020, for Canadian Patent Application No. 2,960,731.
United Arab Emirates Examination Report in related application P6000392/2017 dated Dec. 26, 2020.
United Arab Emirates Search Report in related application P6000392/2017 dated Dec. 26, 2020.

* cited by examiner

STAGE TOOL

BACKGROUND OF THE DISCLOSURE

Field of the Disclosure

Embodiments of the present disclosure generally relate to a stage tool for wellbore tubular cementation.

Description of the Related Art

A wellbore is formed to access hydrocarbon bearing formations, such as crude oil and/or natural gas, by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a casing string is lowered into the wellbore. An annulus is thus formed between the string of casing and the wellbore. The casing string is cemented into the wellbore by circulating cement slurry into the annulus. The combination of cement and casing strengthens the wellbore and facilitates the isolation of certain formations behind the casing for the production of hydrocarbons.

Currently, cement flows into the annulus from the bottom of the casing. Due to weak formations or long strings of casing, cementing from the top of the casing may be undesirable or ineffective. When circulating cement into the annulus from the bottom of the casing, problems may be encountered as the cement on the outside of the annulus rises. For example, if a weak earth formation exists, it will not support the cement. As a result, the cement will flow into the formation rather than up the casing annulus.

To alleviate these issues, stage collars have been employed for casing cementing operations. The stage collar includes o-rings that straddle the cementing port to block fluid communication through the cementing port. However, the stage collar may leak because the o-rings are made of an elastomeric material. There is a need, therefor, for a secondary sealing system to prevent fluid communication through the cementing port.

SUMMARY OF THE DISCLOSURE

In one embodiment a stage tool includes a tubular body having a port; a sliding sleeve configured to close fluid communication through the port; and a closing tube configured to close fluid communication through the port.

In another embodiment, a method of closing a stage tool in a wellbore includes supplying fluid through an opening in the stage tool; releasing a closing tube into the wellbore; attaching the closing tube to the stage tool; and allowing a sealing element on the closing tube to swell, thereby forming a seal with the stage tool.

In another embodiment, a method of cementing a casing includes attaching a stage tool to the casing; opening a port in the stage tool; supplying cement through the port; releasing a closing tube into the wellbore; attaching the closing tube to the stage tool; and closing fluid communication of the port with a bore of the casing using the closing tube.

In another embodiment, a method of closing a stage tool in a wellbore includes releasing a closing tube into the wellbore; attaching the closing tube to the stage tool; and expanding the closing tube, thereby closing a port of the stage tool.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
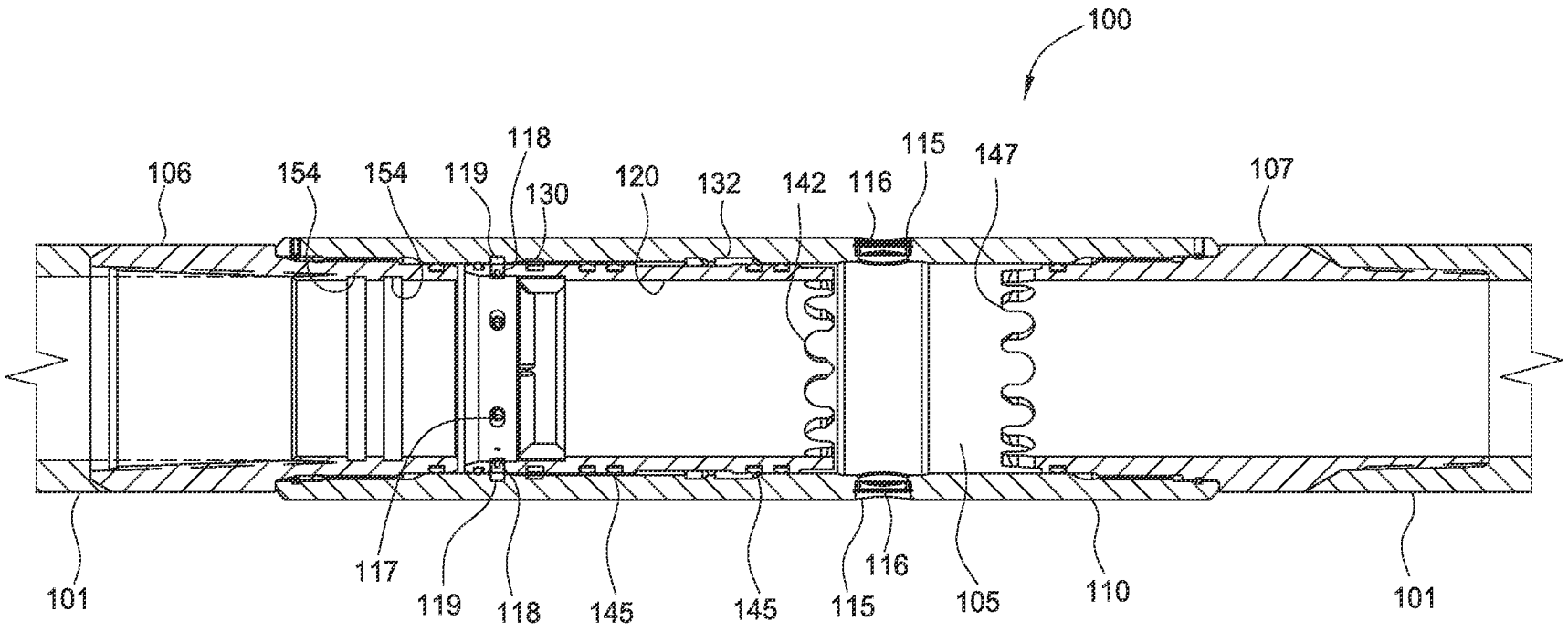
FIG. 1 is a cross-sectional view of an embodiment of a stage tool.

FIG. 1 illustrates an embodiment of a stage tool 100 in a run-in position. The stage tool 100 includes a tubular body 110 having an axial bore 105 extending therethrough. An upper coupling 106 and a lower coupling 107 may be attached to each end of the tubular body 110 for connection to another downhole tool. A sealing element such as an o-ring may be positioned between the tubular body 110 and the upper and lower couplings 106, 107 to prevent fluid communication therethrough. One or more ports 115 are formed through a wall of the tubular body 110. The one or more ports 115 may be circumferentially spaced around the tubular body 110. The stage tool 100 may have two, three, four, or more ports 115. During run-in, the ports 115 are closed using a rupture disc 116. In another embodiment, the ports 115 may be closed using a hydraulically actuatable flow control device such as a pressure relief valve. The ports 115 may be opened to allow cement or other fluid to flow out of the bore 105.

A sliding sleeve 120 is used to close the ports 115 after flowing cement or other fluid. During the run-in, the sliding sleeve 120 is disposed inside the tubular body 110 and above the ports 115. The sliding sleeve 120 is selectively attached to the tubular body 110 using a shear pin 118 or other suitable releasable connection devices such as collets, dogs, a snap ring, or other shearable devices. In one embodiment, a plurality of shear pins 118 extend between a groove 119 formed in the interior surface of the tubular body 110 and respective openings 117 formed in the sliding sleeve 120. The shear pins 118 retain the sliding sleeve 120 above the ports 115 during the cementing process. After shear pins 118 are broken, the sliding sleeve 120 may travel downward to close the ports 115.

The sliding sleeve 120 includes a second releasable connection device for retaining the sliding sleeve 120 in the lower position. In one example, a snap ring 130 on the sliding sleeve 120 is configured to engage a recess 132 in the tubular body 110 to retain the sliding sleeve 120 in the lower position. Other suitable releasable connection devices include collets and dogs.

A catcher 140 for receiving a released object such as a ball, a plug, or a dart is disposed inside the sliding sleeve 120. The catcher 140 may receive the released object to close fluid communication through the bore 105, thereby allowing pressure to build above the catcher 140. At a predetermined pressure, the downward force exerted on the sliding sleeve 120 will break the shear pin 118, thereby allowing the sliding sleeve 120 to move downward. When a higher, second predetermined pressure is reached, the released object is moved past the catcher 140. In one embodiment, the catcher 140 is deformable such as by expansion or extrusion to allow the released object to pass through. Exemplary catchers include a c-ring or an elastomeric seat. For example, the catcher 140 is an expandable ball seat configured to receive a dropped ball. In another embodiment, the released object is deformable. For example, the released object can be an elastomeric, extrudable ball. In yet another embodiment, both the catcher and the released object are deformable.

A plurality of sealing elements 145 are disposed on the exterior surface of the sliding sleeve 120 for forming a seal between the sliding sleeve 120 and the tubular body 110. The plurality of sealing elements 145 are configured to straddle the ports 115 when the sliding sleeve 120 is in the lower position. In one example, two o-rings may be used on each side of the ports 115 to prevent fluid communication between the bore 105 of the tubular body 110 and the ports 115. In another example, the sealing elements 145 may be disposed on the interior surface of the tubular body 110 and configured to mate with the sliding sleeve 120 when the sliding sleeve 120 is in the lower position. Although two o-rings are shown, one, three, or more o-rings may be positioned on each side of the ports 115.

The lower end of the sliding sleeve 120 may optionally include castellations 142 configured to engage with mating castellations 147 formed on the upper end of the lower coupling 107. When mated, the castellations 142, 147 prevent the sliding sleeve 120 from rotating relative to the tubular body 110. The castellations 142, 147 may also act as a stop to prevent the continued downward movement of the sliding sleeve 120 relative to the tubular body 110. In one example, the castellations 142, 147 may be regularly spaced notches having any suitable shape such as arcuate or rectangular.

Figure 3:
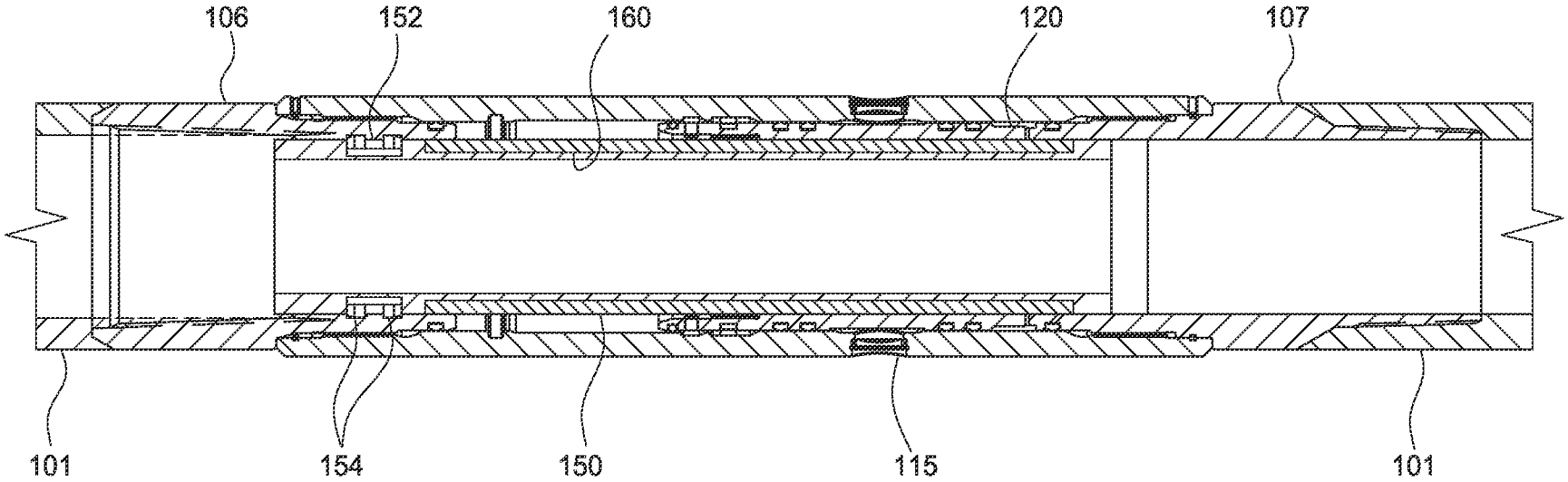
FIG. 3 illustrates the stage tool of FIG. 1 with a closing tube disposed therein.

Referring to FIG. 3, a closing tube 150 may be used to close the ports 115. The closing tube 150 may be released from the surface to land in the tubular body 110 to close the ports 115 in addition to using the sliding sleeve 120 or as an alternative to the sliding sleeve 120. In one embodiment, the closing tube 150 may include a locking member 152 configured to engage with the upper coupling 106 or the tubular body 110. For example, the closing tube 150 includes a lock ring 152 configured to engage with one or more grooves 154 formed in the interior surface of the upper coupling 106. The length of the closing tube 150 is sufficiently long such that the lower end extends into the lower coupling 107. In one embodiment, the closing tube 150 is deformable by hydroforming. Fluid pressure may be used to expand the closing tube 150 such that a metal to metal seal may be formed between the closing tube 150 and the lower coupling 107, and the closing tube 150 and the upper coupling 106, the closing tube 150 and the sliding sleeve 120, the closing tube 150 and the tubular body 110, or a combination thereof. In one example, after expansion, the inner diameter of the closing tube 150 is substantially the same size as the inner diameter of the casing 101. For example, after expansion, the inner diameter of the closing tube 150 is at least 90%, or at least 95% of the inner diameter of casing 101.

In another embodiment, a sealing layer 160 is disposed around the exterior of the closing tube 150 such that a seal may be formed between the closing tube 150 and the lower coupling 107, and also the closing tube 150 and the upper coupling 106, the closing tube 150 and the sliding sleeve 120, the closing tube 150 and the tubular body 110, or a combination thereof. The sealing layer 160 may be made of an elastomeric material. In one example, the sealing layer 160 is a swellable elastomer. The swellable elastomer may be activated by a wellbore fluid such as water or hydrocarbon, a temperature in the wellbore, or both. After activation, the swellable elastomer may expand into engagement with the lower coupling 107, the upper coupling 106, the sliding sleeve 120, or the tubular body 110. In another embodiment, the closing tube 150 is deformable and includes a swellable elastomeric sealing layer 160. The use of swellable elastomers advantageously allows the closing tube 150 to be deployed having an outer diameter that is less than the inner diameter of the casing 101 or a required sealing inner diameter. For example, the outer diameter of the swellable elastomer is not more than 95%, not more than 90%, or not more than 80% of the inner diameter of the casing 101 or the required sealing inner diameter.

In operation, the stage tool 100 may be attached to a tubular such as a casing 101 and run into the wellbore. A ball seat is installed below the stage tool 100 in the casing 101. The stage tool 100 is run in the configuration shown in FIG. 1. The ports 115 are closed by a rupture disc 116 and the sliding sleeve 120 retained in the upper position above the ports 115. To begin cementing, a ball is dropped into the casing 101 to land in the ball seat below the stage tool 100. The ball closes fluid communication below the stage tool 100. Pressure is increased above the ball until the pressure reaches a pressure sufficient to break the rupture disc 116. Cement pumped down casing 101 flows out of the casing 101 through the ports 115. The cement fills an annular area between the casing 101 and the wellbore or a pre-existing outer casing.

Figure 2:
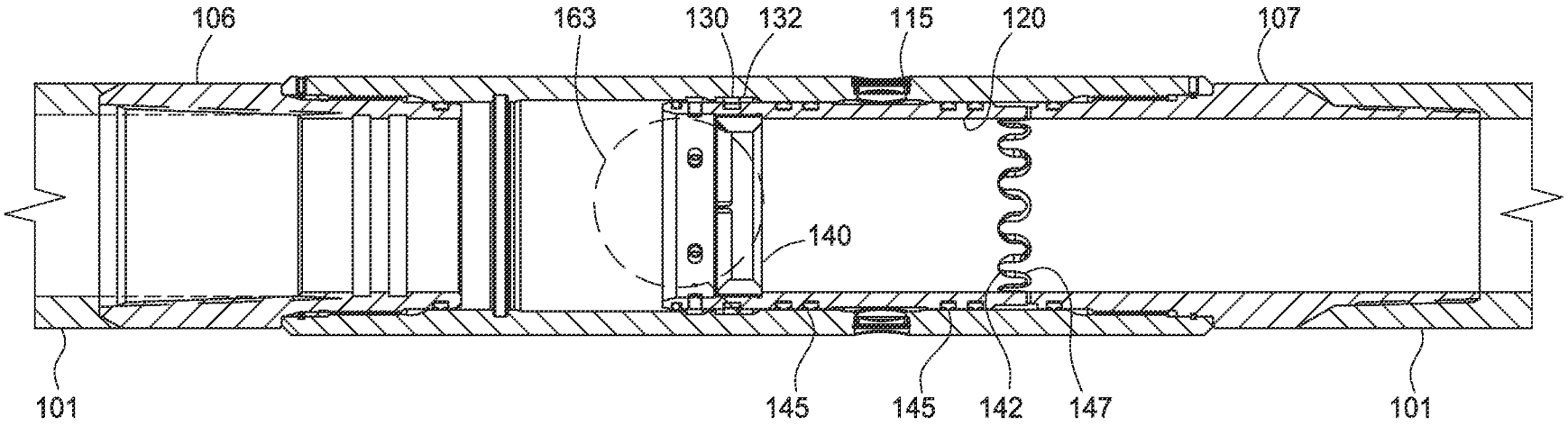
FIG. 2 illustrates the stage tool of FIG. 1 in a closed position.

To close the ports 115, another ball 163 or plug is released into the casing 101 to land in the catcher 140 of the sliding sleeve 120, as shown in FIG. 2. Then, pressure is increased above the catcher 140 until the pressure reaches a predetermined pressure sufficient to break the shearable pins 118. After the pins 118 are sheared, the sliding sleeve 120 moves downward such that the ports 115 are located between two sealing elements 145 on the sliding sleeve 120, as shown in FIG. 2. Optionally, the castellations 142 of the sliding sleeve 120 engage the mating castellations 147 of the lower coupling 107. After closing the ports 115, the ball 163 is removed to re-establish fluid communication through the casing 101. In one example, the ball 163 is drilled out. In another example, the ball 163 can be released from the catcher 140 by increasing the pressure to expand the catcher 140, deform the ball 163, or both. In yet another example, the ball 163 is made of material that is dissolvable such as poly(D,L-lactide), cross-linked poly(D,L-lactide), and the copolymers of glycolide and D,L-lactide. The ball 163 will breakup over time to re-establish fluid communication through the casing 101.

In some instances, a secondary closure operation is performed to seal the ports 115. In one example, a closing tube 150 is released into the casing 101 to close the ports 115 from fluid communication. The closing tube 150 travels downward and attaches to the stage tool such as by engaging the grooves 154 of the upper coupling 106. In one embodiment, the locking member 152 engages the grooves 154 to retain the closing tube 150 in position. As shown, the closing tube 150 lands in the stage tool above the sliding sleeve 120. The closing tube 150 extends across the ports 115 and contacts the inner surface of the lower coupling 107. If equipped with a swellable elastomer 160 on its exterior, the elastomer 160 will swell over time to form a seal with the inner surface of one or more of the upper coupling 106, lower coupling 107, the tubular body 110, and the sliding sleeve 120. The swellable elastomer seal will prevent the bore 105 from fluid communication with the ports 115. In another embodiment, the closing tube 150 may be expanded using hydraulic pressure. Expansion for the closing tube 150 against the tubular body 110 provides a secondary sealing mechanism for the closing tube 150. In yet another embodiment, the closing tube 150 is not equipped with an elastomer and relies on expansion of the closing tube 150 to form the seal to close fluid communication with the ports 115. In yet another embodiment, the closing tube 150 includes an optional sealing element disposed at each end. Expansion of the closing tube 150 against the tubular body 110 also expands the sealing elements into sealing contact with the tubular body 110. For example, the optional sealing elements may be expanded into engagement with the upper coupling 106 and the lower coupling 107.

Figures 4, 4A:
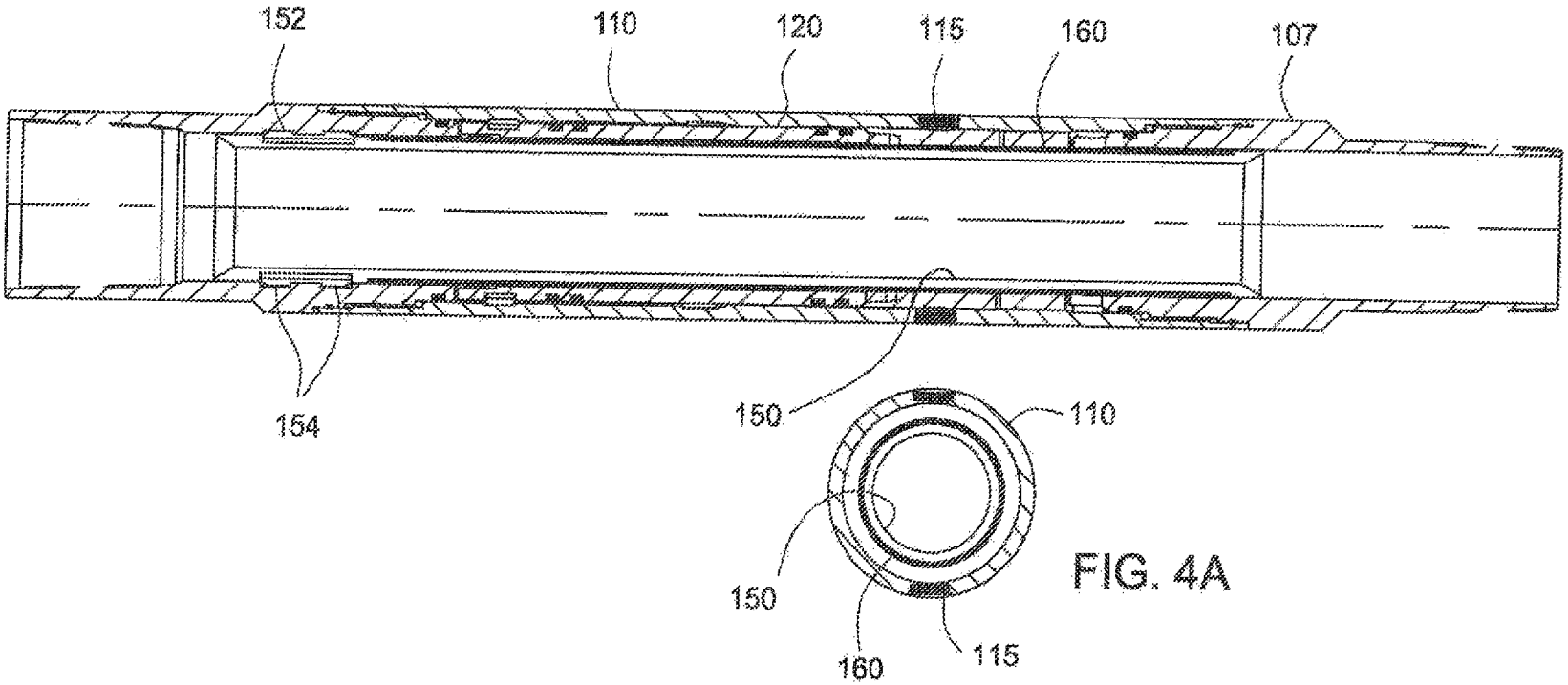
FIG. 4 illustrates the stage tool of FIG. 1 with a closing tube disposed therein.
FIG. 4A is a cross-sectional view of the stage tool.

In another embodiment, the closing tube 150 may be used as an alternative to the sliding sleeve 120 to close the ports 115. Referring to FIGS. 4 and 4A, the sliding sleeve 120 is positioned above the ports 115. FIG. 4A is a cross-sectional view of the stage tool 100. The sliding sleeve 120 may not have been released or may be stuck in the tubular body 110. The closing tube 150 may be released to close the ports 115. As, shown, the locking member 152 engages the grooves 154 to retain the closing tube 150 in position. The closing tube 150 extends across the ports 115 and contacts the inner surface of the lower coupling 107. If equipped with a swellable elastomer 160 on its exterior, the elastomer 160 will swell over time to form a seal with the inner surface of one or more of the upper coupling 106, lower coupling 107, the tubular body 110, and the sliding sleeve 120. The swellable elastomer seal will prevent the bore 105 from fluid communication with the ports 115. In another embodiment, the closing tube 150 may be expanded using hydraulic pressure.

In another embodiment, a stage tool includes a tubular body having a port; a sliding sleeve configured to close fluid communication through the port; and a closing tube configured to close fluid communication through the port.

In one or more embodiments described herein, the closing tube includes a sealing element disposed on an exterior surface.

In one or more embodiments described herein, the sealing element includes a swellable elastomer.

In one or more embodiments described herein, the closing tube is hydraulically deformable.

In one or more embodiments described herein, the sealing element extends across the port.

In one or more embodiments described herein, at least two sealing elements are provided, and at least one sealing element is disposed on each side of the port.

In one or more embodiments described herein, the stage tool includes a locking device for attaching the closing tube to the tubular body or a coupling of the stage tool.

In one or more embodiments described herein, the locking device is configured to engage a groove in the stage tool.

In one or more embodiments described herein, the closing tube is hydraulically deformable to form a seal with the stage tool.

In another embodiment, a method of closing a stage tool in a wellbore includes supplying fluid through an opening in the stage tool; releasing a closing tube into the wellbore; attaching the closing tube to the stage tool; and allowing a sealing element on the closing tube to swell, thereby forming a seal with the stage tool.

In another embodiment, a method of closing a stage tool in a wellbore includes releasing a closing tube into the wellbore; attaching the closing tube to the stage tool; and expanding the closing tube, thereby closing a port of the stage tool.

In another embodiment, a method of cementing a casing includes attaching a stage tool to the casing; opening a port in the stage tool; supplying cement through the port; releasing a closing tube into the wellbore; attaching the closing tube to the stage tool; and closing fluid communication of the port with a bore of the casing using the closing tube.

In one or more of the embodiments described herein, closing fluid communication comprises expanding the closing tube against the stage tool.

In one or more of the embodiments described herein, the closing tube is expanded using hydraulic pressure.

In one or more of the embodiments described herein, closing fluid communication comprises allowing a sealing element on the closing tube to swell.

In one or more of the embodiments described herein, wherein expanding the closing tube comprises allowing a sealing element of the closing tube to expand.

In one or more of the embodiments described herein, attaching the closing tube comprises engaging a locking device to the stage tool.

In one or more of the embodiments described herein, the locking device engages a coupling of the stage tool or a body of the stage tool.

In one or more of the embodiments described herein, the locking device engages a groove in the stage tool.

In one or more of the embodiments described herein, the closing tube attaches to the stage tool at a location above the sliding sleeve.

In one or more of the embodiments described herein, the closing tube attaches to a coupling of the stage tool or a body of the stage tool.

In one or more embodiments described herein, the method includes closing the stage tool using a sliding sleeve before attaching the closing tube to the stage tool.

In one or more embodiments described herein, the sealing element is disposed on an outer surface of the closing tube.

In one or more embodiments described herein, the method includes landing an actuating object in the sliding sleeve and releasing the sliding sleeve.

In one or more embodiments described herein, the method includes removing the actuating object from the sliding sleeve.

In one or more embodiments described herein, removing the actuating object includes drilling out the actuating object.

In one or more embodiments described herein, the method includes landing an actuating object in a sliding sleeve; and moving the sliding sleeve to close the port before attaching the closing tube to the stage tool.

In one or more embodiments described herein, the actuating object is selected from the group of a ball, a plug, a dart, and combinations thereof.

In one or more embodiments described herein, the closing tube is released from surface.

In one or more embodiments described herein, opening the port comprises increasing pressure to break a rupture disc.

While the foregoing is directed to embodiments of the present disclosure, other and further embodiments of the disclosure may be devised without departing from the basic scope thereof, and the scope of the invention is determined by the claims that follow.

The invention claimed is:

1. A cementing assembly, comprising:

a stage tool comprising:

a tubular body having a port and an axial bore; and a sliding sleeve movable relative to the tubular body to close the port; and a closing tube releasable from an earth surface independently from the stage tool and configured to:

contact the stage tool downhole at a first contact location above the sliding sleeve and at a second contact location below the sliding sleeve to thereby straddle an entirety of the sliding sleeve, and seal fluid communication through the port from the axial bore, the closing tube expandable to form a seal with the stage tool.

2. The cementing assembly of claim 1, wherein the closing tube includes a sealing element disposed on an exterior surface.

3. The cementing assembly of claim 2, wherein the sealing element includes a swellable elastomer.

4. The cementing assembly of claim 2, wherein the sealing element extends across the port.

5. The cementing assembly of claim 2, wherein at least two sealing elements are provided, and at least one sealing element is disposed on each side of the port.

6. The cementing assembly of claim 1, further comprising a locking device for attaching the closing tube to the tubular body or a coupling of the stage tool.

7. The cementing assembly of claim 6, wherein the locking device is configured to engage a groove in the stage tool.

8. A method of cementing a casing, comprising:

attaching a stage tool to the casing, the stage tool comprising:

a tubular body, and a sliding sleeve;

opening a port in the stage tool;

supplying cement into the casing and through the port;

closinq the port by moving the sliding sleeve relative to the tubular body;

releasing a closing tube into the casing to seal the port;

attaching the closing tube to the stage tool, wherein the closing tube straddles an entirety of the sliding sleeve by contacting the stage tool at a first contact location above the sliding sleeve and at a second contact location below the sliding sleeve; and expanding the closing tube into sealing contact with the stage tool.

9. The method of claim 8, further comprising allowing a sealing element on the closing tube to expand.

10. The method of claim 8, wherein attaching the closing tube comprises engaging a locking device to the stage tool.

11. The method of claim 8, wherein the closing tube attaches to a coupling of the stage tool or a body of the stage tool.

12. The method of claim 8, wherein opening the port comprises increasing pressure to break a rupture disc.

13. The method of claim 8, further comprising landing an actuating object in the sliding sleeve and releasing the sliding sleeve.

14. The method of claim 13, further comprising removing the actuating object from the sliding sleeve.

15. The method of claim 14, wherein removing the actuating object includes drilling out the actuating object.

16. The method of claim 14, wherein the actuating object is selected from a group consisting of a ball, a plug, a dart, and combinations thereof.

17. The method of claim 8, wherein the closing tube is released from surface.

18. The method of claim 8, wherein the closing tube is attached to the stage tool at the first contact location with a locking member.

19. A method of cementing a casing, comprising:

attaching a stage tool to the casing, the stage tool comprising:

a tubular body having an axial bore, and a sliding sleeve;

opening a port in the stage tool;

supplying cement into the casing and through the port;

closing fluid communication through the port by moving the sliding sleeve relative to the tubular body;

releasing a closing tube into the casing after closing the port; and attaching the closing tube to the stage tool;

wherein the closing tube straddles an entirety of the sliding sleeve by contacting the stage tool at a first contact location above the sliding sleeve and at a second contact location below the sliding sleeve, and whereby the closing tube prevents fluid communication through the port from the axial bore.

* * * * *